United States Patent [19]

Grey

[11] Patent Number: 4,840,502

[45] Date of Patent: Jun. 20, 1989

[54] THERMAL TRANSFER RIBBON CASSETTE

[75] Inventor: Michael O. Grey, Ithaca, N.Y.

[73] Assignee: NCR Corporation, Dayton, Ohio

[21] Appl. No.: 861,216

[22] Filed: May 9, 1986

[51] Int. Cl.[4] ..... B41J 32/02

[52] U.S. Cl. ..... 400/196; 400/120; 400/234

[58] Field of Search ..... 400/120, 194, 195, 196, 400/196.1, 208, 228, 234; 242/55.18, 55.19 R, 55.19 A, 192, 194

[56] References Cited

U.S. PATENT DOCUMENTS

| | | | |
|---|---|---|---|
| 2,734,615 | 2/1956 | Wallendael | 400/224 |
| 2,817,516 | 12/1957 | Daniel | 242/55.19 A |
| 2,922,642 | 1/1960 | Cousino | 242/55.19 A |
| 3,304,019 | 2/1967 | Myers | 242/55.19 A |
| 3,617,010 | 11/1971 | Coy | 242/55.19 A |
| 3,788,574 | 1/1974 | Wakeman et al. | 242/55.19 A |
| 3,822,835 | 7/1974 | Shore | 242/55.19 A |
| 3,863,853 | 2/1975 | Umeda | 242/55.19 A |
| 3,917,186 | 11/1975 | Solomon | 242/55.19 A |
| 3,981,387 | 9/1976 | Gottschlich | 400/196 |
| 3,995,731 | 12/1976 | Miller et al. | 400/195 |
| 4,011,934 | 3/1977 | Ploby et al. | 400/212 |
| 4,051,944 | 10/1977 | Starr | 400/195 |
| 4,071,132 | 1/1978 | Steinke et al. | 400/195 |
| 4,209,261 | 6/1980 | Bell et al. | 400/196.1 |
| 4,279,390 | 7/1981 | Wu et al. | 242/192 |
| 4,350,451 | 9/1982 | Furrow | 400/228 X |
| 4,493,572 | 1/1985 | Van Ocker et al. | 400/196.1 |
| 4,589,789 | 5/1986 | Quick et al. | 400/196.1 X |
| 4,650,351 | 3/1987 | Engle et al. | 400/234 X |
| 4,708,500 | 11/1987 | Bangs et al. | 400/120 |

FOREIGN PATENT DOCUMENTS

| | | | |
|---|---|---|---|
| 0013339 | 7/1980 | European Pat. Off. | 400/196 |
| 0141412 | 5/1985 | European Pat. Off. . | |
| 1001967 | 8/1965 | United Kingdom | 242/55.19 A |
| 1499152 | 1/1978 | United Kingdom | 400/196 |

OTHER PUBLICATIONS

IBM Technical Disclosure Bulletin, vol. 19, No. 10, Mar. 1977, Entitled: Angled Ribbon Guide, by J. F. Giallo, R. H. Milroy and A. C. Thorpe, p. 3817.

*Primary Examiner*—Ernest T. Wright, Jr.
*Attorney, Agent, or Firm*—Wilbert Hawk, Jr.; Albert L. Sessler, Jr.; George J. Muckenthaler

[57] ABSTRACT

A cassette for an endless thermal ribbon utilized in a thermal printer with the ribbon being unwound from the inside diameter of a spool and rewound on the outside diameter of the spool. The ribbon is guided from the spool to effect an approximate 10 degree skew in its path past the thermal print head and then in contact with a ribbon drive roller prior to rewinding on the spool. A plurality of guide ribs are disposed in radial manner to guide and hold the ribbon in its winding and unwinding motion.

3 Claims, 4 Drawing Sheets

THERMAL TRANSFER RIBBON CASSETTE

BACKGROUND OF THE INVENTION

In the area of thermal printers, it is well-known that the use of such printers is increasing for certain operations that require a reduction in noise levels and at a reasonable cost. While development work is continually progressing to increase the speed of operation with minimum maintenance or care of the equipment, it is seen that improvements are being made to provide a higher quality print with a reduced number of thermal elements.

In the case of thermal printers, it is necessary to minimize the complexity of the thermal print head and the associated electronic controls. In certain prior art printers, it has been common practice to provide a thermal print head having a plurality of thermal printing elements on the surface of the head and wherein selected elements are energized to provide printing on thermal paper or like record media with the print head operating in a stationary or fixed position relative to the printer frame. The thermal printing elements on the print head may take the form of pads or contact surfaces in the shape of characters and connected by conducting runs to side or edge connectors. A flexible flat ribbon-like cable is normally used to connect the power and/or control circuitry with the pads or contact surfaces on the print head and the individual leads or wires of the cable may include end connectors or terminals for contact with the print head pads.

In the field of ink ribbons for printers, a ribbon supply spool and a ribbon take-up spool have been provided on opposite sides of a typing or printing station, together with means for reversing the direction of travel of the ribbon for repeated use thereof in an arrangement for the purpose of obtaining longer ribbon life. Also, the ink ribbon has been made to travel along a line of printing wherein the spools are positioned beyond the ends of the printing line and the ribbon is caused to travel at an angle relative to the print line to utilize a greater portion of the ribbon width. However, in the case of certain high-speed printers, a ribbon substantially as wide as the line of printing may be used and caused to travel in a direction normal to the print line and along with the record media. Additionally, it has been common to provide ink carrying or containing means operably associated with the ribbon for maintaining or replenishing a supply of ink therein for proper and extended-life printing operations.

In present day printers, it is also common practice to provide and use a ribbon cassette carrying an endless ribbon which is caused to be driven past a printing station, and wherein the printing ribbon is either a pre-inked and disposable ribbon or a ribbon which is to be continuously or frequently re-inked during the printing operation. The ribbon cassette itself may be of the stuffing-box type wherein the ribbon is contained within the cassette in random manner and such ribbon is unfolded at the cassette exit and caused to be driven past the printing station and then guided back into the cassette to be folded again in random manner therein. Additionally, a ribbon may be utilized in a Mobius loop configuration within the cassette, the ribbon may be maintained in substantially continuous contact with an inking core or like member, or the ribbon may have a plurality of coils thereof around a central core for controlled inking or re-inking of the ribbon.

More recently, development work in thermal printers has included a shuttling-type print head having approximately 20% of the number of print elements compared to the number of elements on a fixed or stationary head. A ribbon associated with a print head and used for transferring material from the ribbon and onto plain paper may be of the thermal transfer type or of the magnetic thermal transfer type, dependent upon the particular application.

One of the problems encountered with the shuttling print head is that of smudging the thermal paper on which the printed image is formed by reason of pressure or contact between the print head and the paper or between the print head and the platen during travel of the print head across the printer. Since it is common practice to print in one direction of travel of the print head, it is deemed to be an improvement over prior printing apparatus and is advantageous to eliminate or at least reduce the pressure of the print head against the thermal paper and against the platen during the return cycle of the print head and its carriage.

Another of the problems encountered with a shuttling print head involves the thermal printer that utilizes the thermal ribbon for transferring material from the ribbon onto the plain paper. In the case of the thermal transfer ribbon, the printing cycle needs to accommodate the moving print head and the moving ribbon in timed relationship so as effect a complete transfer of the material to the paper. While thermal transfer ribbons have been used both in impact and in non-impact printers, it is important that the ribbon be contained and controlled in a manner to effect sharp and well-defined printed characters.

Representative documentation in the field of ribbon cassettes includes U.S. Pat. No. 3,617,010, issued to D. R. Coy on Nov. 2, 1971, which discloses a magnetic tape carried on a platform of a spool and payed out from the center of the coil. The tape travels past a head and through the nip of a capstan and a pressure roller for returning as an outermost winding on the coil.

U.S. Pat. No. 2,734,615, issued to J. H. Van Wallendael on Feb. 14, 1956, discloses guide means for directing the ribbon along a diagonal across the print line.

U.S. Pat. No. 3,981,387, issued to J. A. Gottschlich on Sept. 21, 1976, discloses a reel with a ribbon having an inner turn unwinding from the coil over a guide rod and an outer turn rewinding on the coil with the ribbon being driven by a feed gear and an idler gear.

U.S. Pat. No. 3,995,731, issued to H. R. Miller et al. on Dec. 7, 1976, shows the ribbon unwinding from the inner portion of the coil and rewinding on the outer portion of the coil.

U. S. Pat. No. 4,011,934, issued to B. I. L. Ploby et al. on Mar. 15, 1977, shows a ribbon being guided to extend obliquely between the printing device and the paper.

U.S. Pat. No. 4,071,132, issued to J. M. Steinke et al. on Jan. 31, 1978, discloses an endless ribbon passing from the inside of a wrapped portion of a roller over a guide member and then back onto the outside of the wrapped portion.

U.S. Pat. No. 4,209,261, issued to D. W. Bell on June 24, 1980, discloses a cassette with the ribbon directed at an angle in its travel past the printing station.

U.S. Pat. No. 4,279,390, issued to E. S. Wu on July 21, 1981, shows a ribbon being guided by a shaft from a supply reel at an angle therefrom, past a print station, and onto a take up reel.

And, IBM Bulletin Vol. 19, No. 10, March 1977, page 3817, shows a ribbon directed at an angle to the print line for distributing print activity over the entire surface area of the ribbon.

SUMMARY OF THE INVENTION

The present invention relates to thermal printers. More particularly, the invention is directed to a thermal transfer ribbon cassette associated with a print head carriage that travels back and forth across the printer and supports a thermal print head for printing on paper which is directed in a path past a platen. In a preferred arrangement of the invention, the print head is caused to be moved across the the printer in one direction of travel wherein the head is urged or biased against the paper and the platen and wherein printing is accomplished in such one direction. When the print head is moved in the opposite or return direction or the return cycle of operation, the carriage and the print head assembly are pivoted away from the paper at which time the ribbon and the paper are advanced past the printing station.

In such preferred arrangement, the print head carriage is supported at a greatly central location thereof from a crosswise shaft in pivotal manner and is supported at an extremity thereof on a plate cam which is rotatably driven by suitable drive means.

The present invention also relates to an endless ribbon cassette which is removably connected to the printer cabinet, the cassette carrying the ribbon in manner and form for travel of the ribbon in a path past the printing station.

The ribbon cassette is made of molded plastic material and includes a cavity or chamber for storing the ribbon. The cassette is formed with guide members to direct the ribbon at an angle in a path past the printing station. The cassette, being a part of and removably attached to the printer cabinet, provides for independent movement of the print head carriage and such carriage is simplified by reason of the cassette being supported in separate manner.

The ribbon cassette is supported from the printer in an arrangement wherein the ribbon is guided past the print head at an angle and is driven in incremental manner during the non-printing cycle of the printer operation. The cassette includes a supply spool and the ribbon is in the form of an endless loop with the ribbon being unwound from the inside diameter of the spool and rewound on the outside diameter of the spool. The cassette includes guide means and support means therein for containing and controlling the ribbon in a precise path and orientation in its travel of operation. The spool includes a concave-shaped surface for directing the ribbon upwardly and over the coils of ribbon during the unwinding thereof.

The cassette includes a ribbon drive roller and a matching driven roller for driving the ribbon in incremental or cyclic manner during the printing operation, such drive roller having suitable drive means connected therewith to provide a simple positive connection for driving the ribbon.

In view of the above discussion, the principal object of the present invention is to provide an improved print head and ribbon cassette arrangement for a thermal printer.

Another object of the present invention is to provide a ribbon cassette for guiding the ribbon in a path past the line of printing.

An additional object of the present invention is to provide a ribbon drive roller and suitable drive means therefor which is simple and positive for driving the ribbon in incremental or cyclic manner.

A further object of the present invention is to provide a ribbon cassette with ribbon storage means and guide means in an arrangement to reduce the overall size of the printer.

Still another object of the present invention is to provide a ribbon cassette with a single spool that enables an endless ribbon to be wound thereon and unwound therefrom.

Still an additional object of the present invention is to provide a ribbon cassette having a body portion with guide means for containing the ribbon in one attitude and orientation, and guide means for directing the ribbon outside the body portion at an angle relative to the line of printing.

Still a further object of the present invention is to provide a ribbon cassette that is compatible with a moving point head in cyclic printing operation.

Additional objects and advantages of the present invention will become apparent and fully understood from a reading of the following specification taken together with the annexed drawing.

DESCRIPTION OF THE PREFERRED EMBODIMENT

Figure 1:
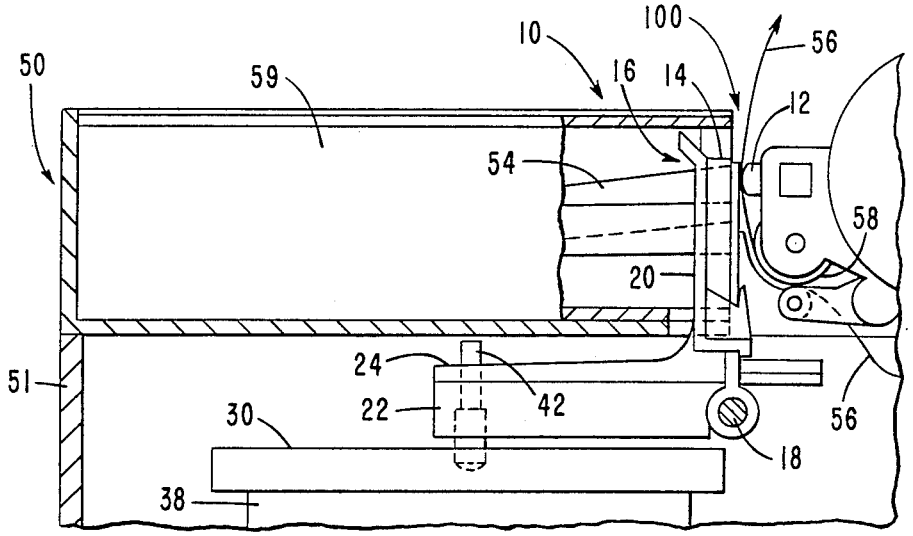
FIG. 1 is a side elevational view of a portion of a printer carrying the ribbon cassette of the present invention.

Referring now to the drawing, FIG. 1 shows a portion of a thermal printer 10 that includes a platen 12 suitably supported from the printer frame. A thermal print head 14 of well-known design and structure is supported from and carried by a print head carriage 16 that is caused to be shuttled or moved in reciprocating manner by appropriate mechanism in the direction of viewing by the observer in FIG. 1. The carriage 16 is pivotally supported on a shaft 18 journaled in the frame of the printer and such carriage 16 includes an upstanding plate portion 20 and a generally horizontal plate portion 22 with gusset means 24 bridging the two portions 20 and 22 at appropriate locations.

A plate-like cam 30 of circular configuration is positioned to be rotatably driven by drive means coupled to the shaft of a motor suitably positioned at the left and downwardly from the plate cam 30. The plate cam 30 is suitably supported by bearing means 38 which, in turn, is supported by a carriage drive plate (not shown). The carriage drive plate and the print head carriage 16 are fully disclosed in co-pending application Ser. No. 849,088, filed Apr. 7, 1986, invented by M. O. Grey, now abandoned and assigned to the assignee of the present invention.

The horizontal plate portion 22 of the print head carriage 16 includes cam follower mechanism 42, the details of such camming mechanism being fully disclosed in co-pending application, Ser. No. 818,413, filed Jan. 13, 1986 invented by R. G. Bangs and M. O. Grey, now U.S. Pat. No. 4,708,500, issued Nov. 24, 1987.

In the case of a thermal printer 10 utilizing a thermal transfer ribbon 54 for transferring material therefrom and onto record media 56, a ribbon cassette 50 is provided and is supported on the frame 51 of the printer 10. The ribbon 54 is provided in coiled form within the cassette 50 and is trained at an angle in a path between the print head 14 and record media, such as paper 56, such paper 56 being caused to be transported by suitable drive means including a drive roller 58. The ribbon 54 and the paper 56 are driven in well-known incremental manner past a print station 100 in the printing cycle of operation.

Referring now to FIGS. 2–5 of the drawing, there is shown the container or enclosure in the manner and form of a cassette, designated as 50, made of a durable plastic material, such as polystyrene, and generally square shaped in a box-like design to contain and enclose a spool or reel 52 for carrying the endless ribbon 54. The cassette 50 includes a bottom portion 57 (FIGS. 4 and 5), side wall portions 59 and 60 (FIGS. 2 and 5), a front wall 62, an irregular-shaped rear wall 64 (FIG. 3), and a cover 66. The spool 52 is journaled on an upstanding bearing member 68 (FIG. 4) fashioned as a part of the cassette 50 and supported by the bottom portion 57, the spool 52 being carried on and supported from a washer-like plate member or element 70 (FIG. 4), also supported by the bottom portion 57 and providing for a separation in elevation between the bottom portion 57 and the spool 52 for free rotation thereof. The top or cover 66 is placed on the cassette 50 and is suitably secured thereto by means of fingers 72 engaging with and held in upstanding posts 74, also an integral part of the several wall portions, to provide a substantially total enclosure for the spool 52 and the ribbon 54 except for providing an opening at the rear of the cassette 50 for ingress and egress of the ribbon 54. It should be stated that the directional terms herein used refer to the cassette 50 as being placed on a surface as seen in FIG. 1, however, the orientation of the cassette 50 may be different in an actual installation.

Figure 3:
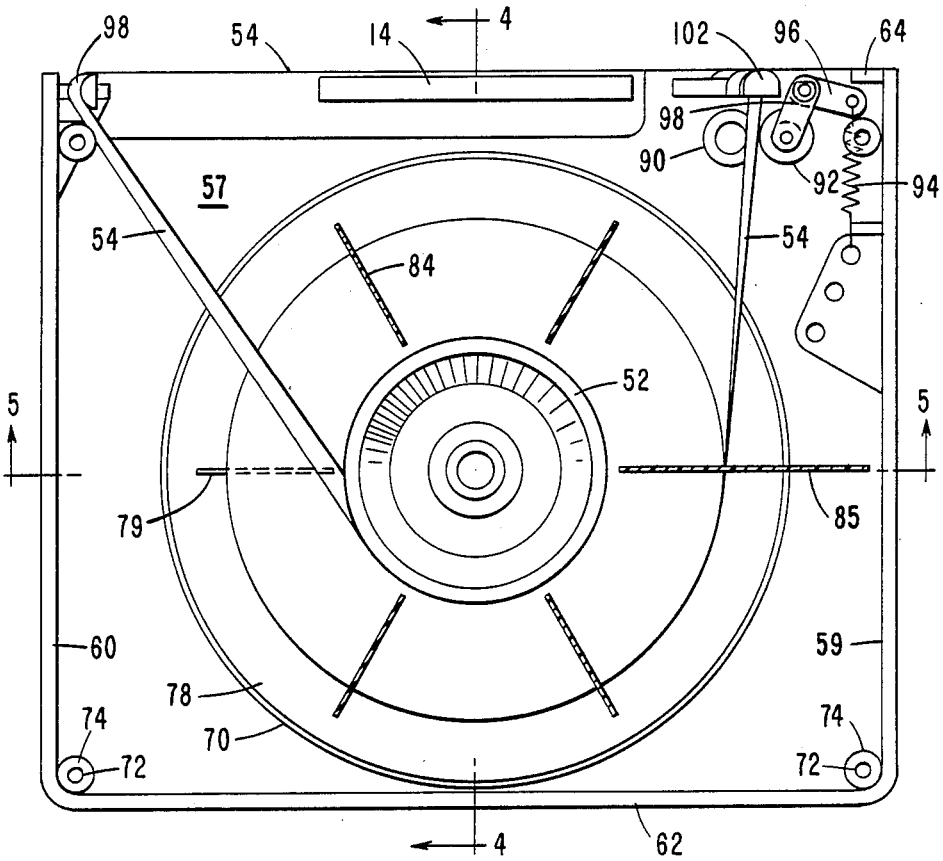
FIG. 3 is a top plan view of the ribbon cassette showing the orientation of the ribbon guide means.
Figure 4:
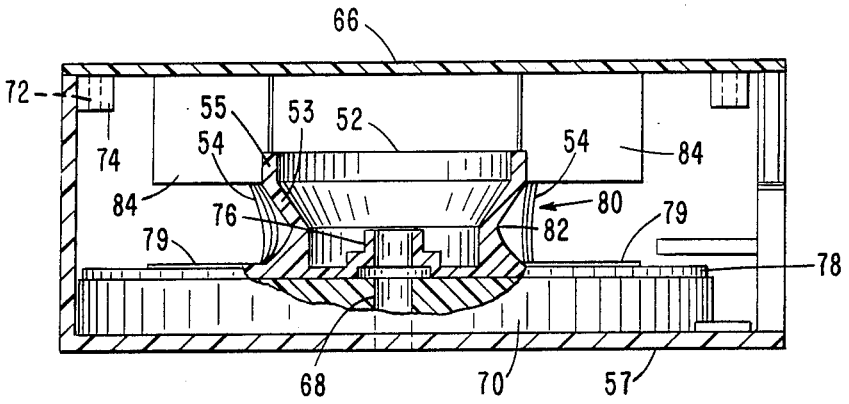
FIG. 4 is a side elevational view, partly in section, of the ribbon cassette with portions of the cassette removed to show certain of the interior parts, such view being taken along the line 4—4 of FIG. 3.
Figure 5:
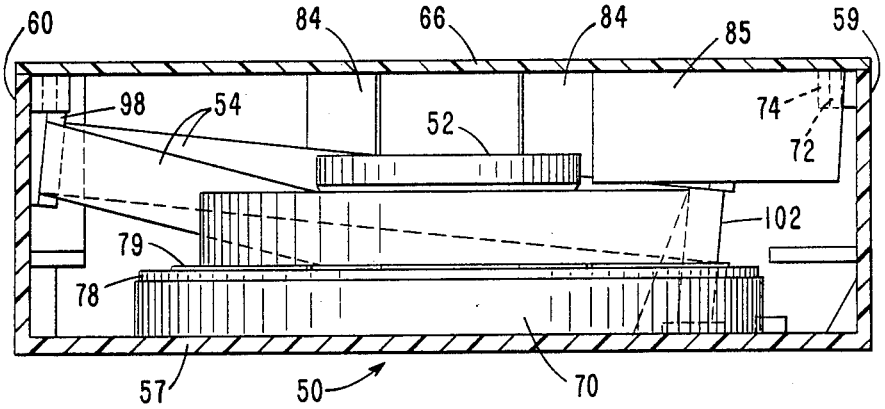
FIG. 5 is a front elevational view, partly in section, of the ribbon cassette, taken along the line 5—5 of FIG. 3.

A hub 76 encircles the bearing member 68 to be rotatable thereon, the ribbon 54 being trained around the spool 52 in at least one or a plurality of coils and carried edge-wise on an extended diametral portion 78 of the spool 52, the portion 78 including a plurality of ribs or ridge portions 79 as an integral part thereof. The spool 52 includes an upstanding circular portion 80 (FIG. 4) which may be formed to provide a surface with which the inner coil of the ribbon 54 is in contact during its travel around the spool 52. The upstanding portion 80 presents a peripheral surface which is substantially concave-shaped or inclined and exhibits a smaller diameter central portion 82 of the spool 52 than the upper or lower edges of the side of the portion 80, so as to maintain the ribbon 54 in a condition to be in such edgewise contact with the extended diametral base portion 78 of the spool 52. In this respect, the coil or coils of the ribbon 54 are made to be contained in a precise path around the circumference of the spool portion 82. Additionally, the cover 66 includes a plurality of rib or guide plates or like members 84 (FIGS. 3, 4 and 5) integral therewith and radially spaced from the center of the spool 52 for generally guiding the ribbon into and out of the cassette 50 and for providing limits to prevent the coils or ribbon 54 from climbing out of their edge-wise attitude and over other coils. There are provided six of the ribbon support ribs 79 substantially equally spaced around the spool 52 and there are provided five of the rectangular-shaped guide members 84 (FIG. 3) around the spool 52. A guide member 85 at the right side of FIG. 3 is longer and extends further from the spool 52 than do the other four guide members 84. It is seen in FIGS. 4 and 5 that the ribs 79 support and carry the ribbon 54 in edge-wise manner thereon and provide a certain amount of drag or friction on the ribbon 54 to enable sure and precise winding of the ribbon 54 on the spool 52. The guide plates 84, 85 and the ribs 79 direct the ribbon 54 into a precise attitude for substantially holding thereof to the concave shape or contour of the spool 52 in rewinding of the ribbon 54.

Figure 2:
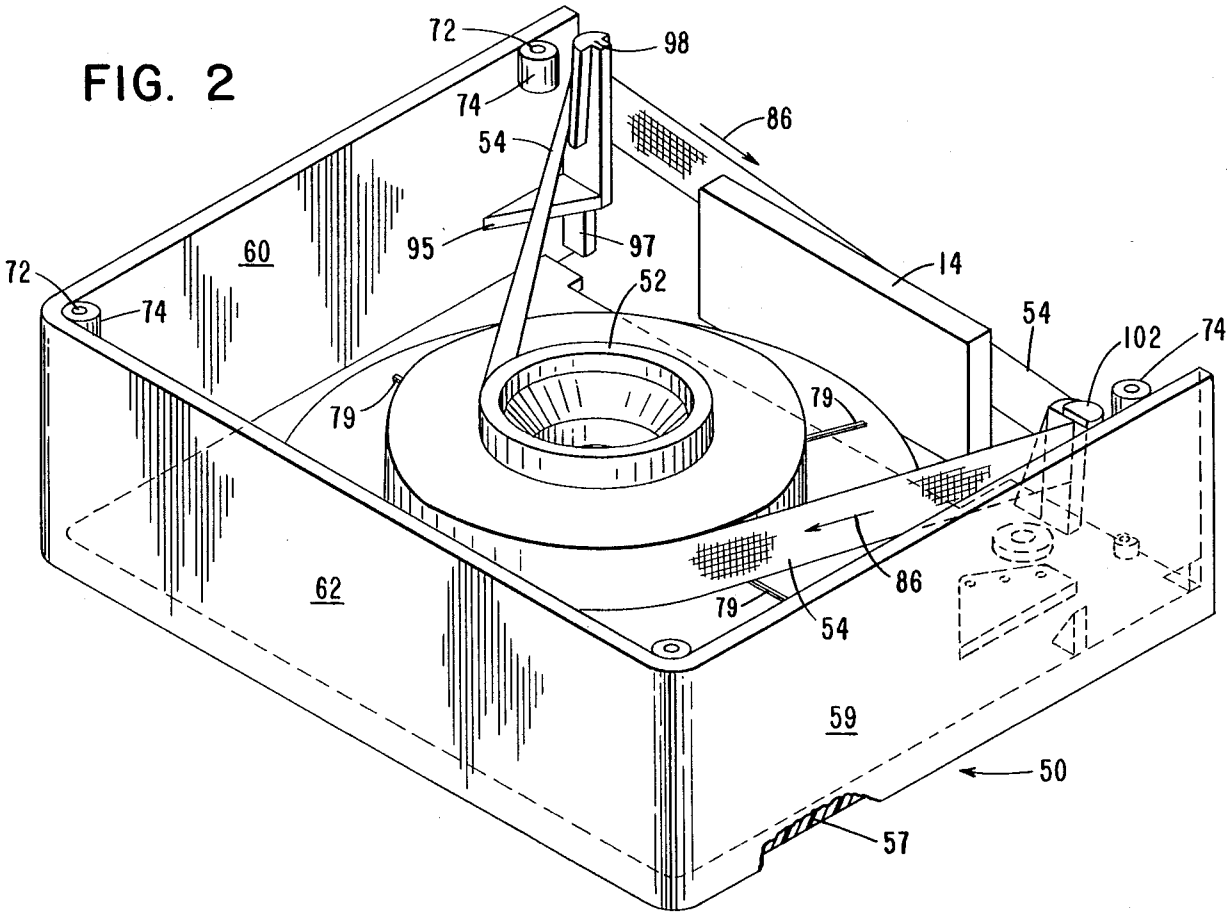
FIG. 2 is a perspective view of the ribbon cassette.

As seen in FIG. 2 of the drawing, the ribbon 54 travels in a generally circular path as indicated by the arrow 86 upon rotation of the spool 52 in a clockwise direction, the ribbon 54 being wound or wrapped on the outside of the coils, as indicated on the right side of the spool 52, and such ribbon 54 being unwound or unwrapped from the inside of the coils thereof, as indicated on the left side of the spool 52. In other words, the rewind wrap is on the outside of the coils of ribbon 54 and the unwind wrap is from the inside of the coils. It should be here noted that the concave shape of the spool 52 enables the ribbon 54 to be directed from the inside coil and guides the ribbon 54 at an angle or slant upwardly and over the coils or ribbon 54 as the ribbon 54 emerges from the spool 52. The ribbon 54 is shown in diagrammatic form in FIG. 4 on either side of the spool 52 and assumes a slanted attitude as shown at the left side thereof, by reason of the inclined portion 53 of the spool 52 which is integral with a straight wall portion 55, as such portion 53 causes the ribbon 54 to move in a path up and over the coils when unwinding from the spool 52. Suffice it to say that the number of coils around the spool 52 may depend upon the particular application of the endless ribbon 54, certain parameters of design being the length of the ribbon loop, and the type of thermal coating means being utilized on the ribbon 54. It is also desirable to state that a preferred design is to provide at least one complete coil of the ribbon 54 around the spool 52 for purposes of control and tension of the ribbon 54.

Drive means for the ribbon 54 is from mechanism generally positioned interior of the rear wall 64 of the cassette 50 and may be contained in a separate package or in an extension of the cassette 50. The drive means per se for the ribbon 54 forms no part of the present invention, but a showing is made of a drive element or roller 90 which may have a knurled or serrated surface engageable with the ribbon 54 for driving thereof, there being an adjacent roller 92 which also may have a knurled surface thereon and which is biased by means of a spring 94 connected with an arm portion 96 of a pivot member 98 and arranged to place pressure on the roller 92 and against the ribbon 54 and toward the drive element 90 to provide precise engagement of the ribbon 54 with the roller 90 and the roller 92.

Travel of the ribbon 54 in a path in unwinding thereof from the spool 52 is across a guide member 95 (FIG. 2) supported from side wall portion 60 and from an ear 99 on the rear wall 64, the ribbon 54 being guided upwardly at an angle from the spool 52 (see also Fig. 5). The ribbon 54 then travels around a post or like member 98 at the left rear corner of the cassette 50 which acts as a guide to direct the ribbon 54 downwardly at a proper attitude or angle of about 10 degrees in a path toward and past a printing station, generally designated as 100 (FIG. 1), the ribbon 54 then being trained around a corner post or like member 102 (FIG. 2), and the ribbon 54 again being changed in its attitude to that coinciding with the coils around the spool 52, in effect taking a one-quarter turn around such guide post 102 in traveling in a path past the printing station 100, past the drive element 90 and roller 92 to engage with one of the guide elements 85 positioned to guide and contain the ribbon 54, and into the attitude for winding onto the spool 52 and coiling therearound.

It is thus seen that herein shown and described is a ribbon cassette 50 for use in thermal printing operations wherein the ribbon 54 is wound on and unwound from a single spool 52 and is directed in a path past a printing station 100, the cassette 50 being a complete package within itself for performing the desired result. A ribbon cassette 50 is provided with a plurality of coils of ribbon 54 in an endless loop, and the several guide means keep and contain the ribbon 54 in a precise path in its travel from the spool 52, past the printing station 100 and back to the desired attitude around the spool 52. The ribbon guide means 84, 85 and the ribbon support means 79 maintain the ribbon 54 in a path therebetween in directing and coiling the ribbon 54 toward the contour of the spool 52. The apparatus of the present invention enables the accomplishment of the objects and advantages mentioned above, and while a preferred embodiment has been disclosed herein, certain other variations may occur to those skilled in the art. It is contemplated that all such variations, not departing from the spirit and scope of the invention hereof, are to be construed in accordance with the following claims.

I claim:

1. A ribbon cassette for use in a printer and containing an endless ribbon to be unwound from a coil of said endless ribbon, driven past a printing station and then rewound onto the coil of said endless ribbon, said ribbon cassette comprising a housing portion and a cover portion, a rotatable plate member supported in the housing portion and comprising a solid bottom flange member and having a plurality of radially extending ribs for supporting the coil of endless ribbon at one elevation in edge-wise manner on said ribs.

means for driving said endless ribbon at an angle past the printing station, spool means around which the coil of endless ribbon is positioned in an arrangement wherein the endless ribbon is unwound from the inside of said coil of endless ribbon and is rewound on the outside of said coil of endless ribbon, said spool means including a concave-shaped wall portion defining a substantially concave surface on the exterior thereof for containing said coil of endless ribbon therearound, said solid bottom flange member extending from said concave-shaped wall portion and said radially extending ribs being disposed on the upper surface of said flange member to raise said endless ribbon above the upper surface of said flange member, and guide means comprising a plurality of plate members integral with said cover portion and positioned around and spaced from the spool means and extending in radial manner from the center of the coil of endless ribbon and spaced upwardly from the ribs on the rotatable plate member for guiding said endless ribbon from the concave surface of the spool means in unwinding of the endless ribbon therefrom and for holding the endless ribbon in a configuration substantially corresponding with the contour of the concave surface in rewinding of the endless ribbon around the coil thereof.

2. In a cassette for an endless printing ribbon to be driven at an angle past a printing station, said cassette comprising a housing portion and a cover portion, rotatable means comprising a solid bottom flange member having a plurality of radially extending ribs for supporting a coil of the endless printing ribbon in edge-wise manner on said ribs, spool means around which the coil of endless printing ribbon is positioned in an arrangement wherein the endless printing ribbon is unwound from the inside of said coil and is rewound on the outside of said coil, said spool means including said flange member as an integral portion thereof and having a substantially concave-shaped wall portion extending upwardly from the flange member for containing said endless printing ribbon around the concave-shaped wall portion, said solid bottom flange member extending from said concave-shaped wall portion and said radially extending ribs being disposed on the upper surface of said flange member to raise said endless printing ribbon above the upper surface of said flange member, and guide means comprising a plurality of substantially rectangular plate members integral with said cover portion and positioned around and spaced from the spool means and extending in radial manner from the center of the coil of endless printing ribbon and spaced upwardly from the ribs on the flange member for guiding the endless printing ribbon from the concave-shaped wall portion of the spool means and for holding the endless printing ribbon in a configuration substantially corresponding with the contour of the concave-shaped wall portion.

3. A cassette for an endless thermal transfer ribbon for use in a thermal printer, said cassette comprising a housing and a cover therefor, a rotatable plate member supported within the housing and comprising a solid bottom flange member and having a plurality of radially extending ribs for carrying a coil of said endless thermal transfer ribbon in edge-wise manner on said ribs, a spool member supported from the flange member and around which the coil of endless thermal transfer ribbon is positioned, said spool member including said flange member as an integral portion thereof and having an upstanding portion defining a substantially concave wall portion and a straight wall portion extending from the concave wall portion, said solid bottom flange member extending from said concave wall portion and said radially extending ribs being disposed on the upper surface of said flange member to raise said endless thermal transfer ribbon above the upper surface of said flange member, and guide means comprising a plurality of plate members integral with said cover and extending in radial manner from the center of the coil of endless thermal transfer ribbon and oriented in a direction normal to and positioned above the coil of endless thermal transfer ribbon and spaced from the ribs on the flange member for guiding the endless thermal transfer ribbon from the inside of the coil of endless thermal transfer ribbon to a position for training the endless thermal transfer ribbon past a printing station and then for holding the endless thermal transfer ribbon in a configuration for rewinding on the outside of the coil of endless thermal transfer ribbon in an attitude substantially corresponding to the contour of the concave wall portion.

* * * * *